US008243972B2

(12) United States Patent
Latzel

(10) Patent No.: US 8,243,972 B2
(45) Date of Patent: Aug. 14, 2012

(54) METHOD AND APPARATUS FOR THE CONFIGURATION OF SETTING OPTIONS ON A HEARING DEVICE

(75) Inventor: Matthias Latzel, Eggolsheim (DE)

(73) Assignee: Siemens Medical Instruments Pte. Lte., Singapore (SG)

( * ) Notice: Subject to any disclaimer, the term of this patent is extended or adjusted under 35 U.S.C. 154(b) by 568 days.

(21) Appl. No.: 12/319,860

(22) Filed: Jan. 13, 2009

(65) Prior Publication Data

US 2009/0180650 A1 Jul. 16, 2009

(30) Foreign Application Priority Data

Jan. 16, 2008 (DE) ..... 10 2008 004 659

(51) Int. Cl.
*H04R 25/00* (2006.01)
*H01R 25/00* (2006.01)

(52) U.S. Cl. ..... 381/314; 381/23.1; 381/60; 381/312; 381/313; 381/315; 381/316; 381/317; 381/323

(58) Field of Classification Search ..... 381/23.1, 381/312–317, 323, 60
See application file for complete search history.

(56) References Cited

U.S. PATENT DOCUMENTS 5,717,770 A * 2/1998 Weinfurtner ..... 381/316
6,044,163 A * 3/2000 Weinfurtner ..... 381/312
6,094,489 A * 7/2000 Ishige et al. ..... 381/60
6,463,411 B1 * 10/2002 Li et al. ..... 704/226
6,529,607 B1 * 3/2003 Sigwanz et al. ..... 381/107
6,658,122 B1 * 12/2003 Westermann et al. ..... 381/312
6,879,692 B2 * 4/2005 Nielsen et al. ..... 381/60
6,970,570 B2 * 11/2005 Goldstein ..... 381/321
7,181,033 B2 * 2/2007 Fischer et al. ..... 381/317
7,190,292 B2 * 3/2007 Bizjak ..... 341/139
7,251,339 B2 * 7/2007 Ryan ..... 381/315
7,596,237 B1 * 9/2009 Constantin ..... 381/314
7,715,571 B2 * 5/2010 Boretzki et al. ..... 381/60
7,961,898 B2 * 6/2011 Van Den Heuvel ..... 381/314
2001/0005420 A1 * 6/2001 Takagi et al. ..... 381/312
2002/0057814 A1 * 5/2002 Kaulberg ..... 381/312
2003/0064746 A1 * 4/2003 Rader et al. ..... 455/550
2004/0028250 A1 * 2/2004 Shim ..... 381/312
2004/0196993 A1 * 10/2004 Ryan ..... 381/314
2004/0202333 A1 * 10/2004 Csermak et al. ..... 381/60
2004/0234089 A1 * 11/2004 Rembrand et al. ..... 381/312
2004/0247148 A1 * 12/2004 Pedersen ..... 381/323
2005/0041824 A1 * 2/2005 Arndt et al. ..... 381/313
2005/0207602 A1 * 9/2005 van Oerle ..... 381/312
2006/0140429 A1 * 6/2006 Klinkby et al. ..... 381/317
2006/0222192 A1 * 10/2006 Matthey ..... 381/312

(Continued)

FOREIGN PATENT DOCUMENTS

EP 0814634 B1 10/2002

(Continued)

*Primary Examiner* — Eugene Lee
*Assistant Examiner* — Mohammed Shamsuzzaman

(57) ABSTRACT

The invention relates to a method and an apparatus for the configuration of at least one adjustment option on a hearing device, with the hearing device wearer having the task of setting the hearing device by ear with the aid of the adjustment option to be configured such that a predetermined characteristic on the hearing device is adjusted, with the adjustment option being enabled if the characteristics set by the hearing device wearer equate to the predetermined characteristics or has deviations herefrom, which lie within a predetermined tolerance range.

19 Claims, 2 Drawing Sheets

U.S. PATENT DOCUMENTS

| | | | | |
|---|---|---|---|---|
| 2006/0222194 | A1* | 10/2006 | Bramslow et al. | 381/314 |
| 2007/0282393 | A1* | 12/2007 | Marquis | 607/55 |
| 2008/0232618 | A1* | 9/2008 | Johannesson | 381/312 |
| 2009/0022346 | A1* | 1/2009 | Kondo et al. | 381/315 |
| 2009/0046878 | A1* | 2/2009 | Sorgel et al. | 381/314 |
| 2009/0262948 | A1* | 10/2009 | Hasler et al. | 381/60 |
| 2010/0008526 | A1* | 1/2010 | De Vries et al. | 381/314 |
| 2010/0027800 | A1* | 2/2010 | Banerjee et al. | 381/60 |
| 2010/0202637 | A1* | 8/2010 | Cornelisse et al. | 381/314 |
| 2011/0202111 | A1* | 8/2011 | Dillon et al. | 607/57 |

FOREIGN PATENT DOCUMENTS

| | | | |
|---|---|---|---|
| EP | 1453356 | A2 | 9/2004 |
| WO | 2007113339 | A2 | 10/2007 |

* cited by examiner

METHOD AND APPARATUS FOR THE CONFIGURATION OF SETTING OPTIONS ON A HEARING DEVICE

CROSS REFERENCE TO RELATED APPLICATIONS

This application claims priority of German application No. 10 2008 004 659.0 filed Jan. 16, 2008, which is incorporated by reference herein in its entirety.

FIELD OF THE INVENTION

The invention relates to a method for the configuration of setting options on a hearing device, as can be provided for instance for the adjustment to different auditory situations, and a hearing device, upon which this method can be implemented.

BACKGROUND OF THE INVENTION

Hearing devices are to provide as natural a hearing perception as possible to hearing-impaired patients and are primarily to largely compensate for medically specific functional interferences in the auditory organs. In this way, allowance is increasingly made for comfort requirements. The object of a hearing device is to convert acoustic pressure into an auditory sensation of the hearing device wearer, which would also occur in the case of physiologically and anatomically intact auditory organs. The hearing devices must thus be able to be adjusted to numerous subjective and objective conditions. These conditions relate to the individual details of the defective hearing in each instance, the selectivity of the perception of a hearing device wearer but also changing auditory situations and/or environmental influences, which may affect a hearing device wearer. Modern hearing devices are generally able to set a plurality of parameters, which influence the transmission and amplification characteristics of the respectively used hearing device. The setting of these parameters is firstly carried out by the manufacturer in the form of a basic setting, which can then be adjusted on the patient in the form of a fine tuning in one or several sessions with a hearing device acoustician. A fine tuning of this type is however associated with significant effort for the patient on the one hand but also for the responsible hearing device acoustician on the other hand, which is frequently perceived by the patient as inconvenient. Hearing devices have thus been established, upon which at least one part of the adjustment and/or fine tuning of the hearing device can be performed independently of a hearing device acoustician, which is preferably carried out by the hearing device wearer him/herself with the aid of a remote controller for instance.

An effective adjustment to an actual auditory situation, particularly in the case of comfortable hearing devices, is however frequently associated with an adjustment of numerous technical parameters, which sometimes places great demands on the technical knowledge of the hearing device wearer, knowledge that is potentially not provided in the case of a layman. As a result, there is the risk of a maladjustment of the hearing device, which can no longer be overcome by the hearing device wearer him/herself, since the identification of optimal settings can prove to be too difficult. Alternatively, the hearing device wearer must then employ a hearing device acoustician again.

The claimed problem notably applies if the individual variable parameters simultaneously form the input variables of complex signal processing algorithms, which in turn influence the transmission and amplification characteristics of the hearing device. Algorithms of this type can be realized for instance to suppress interference noises or to highlight desired acoustic sources in the hearing devices. Examples of this are algorithms for setting the directional characteristics, algorithms for attenuating non-speech parts, for rapid spectral interference noise estimation, for wind noise suppression and many others. The number of setting options automatically increases the risk of maladjustments. This applies particularly if the individually variable parameters do not completely influence the transmission and amplification characteristics of the hearing device independently of one another and/or if ambiguities appear. These ambiguities, in which the subjective impression can be conveyed that different settings or parameter combinations result in apparently identical transmission and amplification characteristics, significantly complicate a reproducible setting of a hearing device. The risk of maladjustments increases further if the hearing device wearer is unable to acoustically perceive the effect of a variable parameter and/or an adjustment of the same, which can result for instance from distinctive features of his/her individual defective hearing. This problem also applies in particular to the use of complex signal processing algorithms with variable parameters as input variables.

It is known to reduce the risk of multi-dimensional maladjustments such that an actual auditory situation is classified, thereby enabling the subsequent assignment of the classified auditory situation to several stored data sets with preset parameters. The selection of the parameter set (EP 0 814 634 B1) which is best suited to a respective auditory situation then takes place interactively in this case. This procedure nevertheless requires the storage of a relatively large number of data records with preset parameters, in order to be able to perform a fine selection of the suitable parameter set and furthermore presupposes the ability of the hearing device wearer to acoustically evaluate differences between the stored settings and to make a qualified selection.

It is also known, based on stored preset parameters and a classification of a certain auditory situation, to offer preset parameter sets which are automatically varied once they have been deselected by the hearing device wearer in the preadjustment offered (EP 1 453 356 A2). A purposeful optimization is also only possible in this case, if the hearing device wearer is able to acoustically perceive and evaluate the effect of varied parameters. Furthermore, a procedure of this type is at least partially related to the predictability of auditory situations which arise, and can thus not completely replace the free setting of parameters and/or signal processing algorithms.

SUMMARY OF THE INVENTION

The object of the invention thus consists in specifying a possibility of being able to adjust a hearing device to as many, also unpredictable, auditory situations as possible and to keep the risk of maladjustments and/or faulty settings as low as possible, even if these are performed by a layman.

This object is achieved by a method for the configuration of at least one adjustment option on a hearing device and by a hearing device as claimed in the independent claims. Further advantageous embodiments of the invention are specified in the dependent claims.

The invention assumes that it is expedient for a reliable performance of adjustments on a hearing device and/or the successful use of particular features in hearing devices to estimate in advance whether the respective user can actually use the advantages of the adjustment option or of the respective feature. As a result, it is possible, particularly in the case of interactive features, to clarify in advance whether the user, who would perform the relevant adjustments, tends to impair or at least render non-reproducible the setting of the hearing device as a result of his/her manipulations. The adjustment of parameters is primarily discussed below. In this way, all possibilities of influencing the efficiency and/or characteristics of a hearing device, in other words activation, deactivation and setting of different features and algorithms are included in the signal processing.

The core of the invention consists in identifying such adjustment options of a hearing device, which cannot be used purposefully by the respective wearer of a hearing device. This may be as a result of the hearing device wearer subjectively perceiving the efficiency of an adjustment of a parameter or a parameter set as too minimal or being unable to quantitatively evaluate this efficiency, as a result of which it is impossible for him to determine a respective trend for an adjustment to be carried out, which would result in him/her better perceiving the transmission and amplification characteristics of the hearing device. After identifying adjustment options of this type, these adjustment options are disabled, i.e. instead of a variable parameter or parameter set, fixedly predetermined reference values are used as input parameters, as a result of which the number of remaining setting options is reduced. The determination of the reference values can also include here the disabling of certain features, the use of which is not advantageous for the respective hearing device wearer.

The invention generally consists of a method for the configuration of at least one adjustment option on a hearing device, in which the hearing device wearer has the task of setting the hearing device in accordance with the hearing, with the aid of the adjustment option to be configured, such that a predetermined characteristic is set on the hearing device, with the adjustment option being enabled if the characteristic set by the hearing device wearer equates to the predetermined characteristic or has deviations herefrom, which lie within a predetermined tolerance range. The same characteristics will then frequently occur if the tested adjustment options are such adjustment options which are implemented in discrete adjustment steps. Absolutely identical settings cannot generally be reproduced as in the case of continually changeable variables, a corresponding tolerance range must be defined, the compliance with which allows the set object to be regarded as having been achieved. The solution of the set object qualifies the hearing device wearer as a candidate for the use of the adjustment options to be configured on his/her hearing device. The characteristics of the hearing device are understood, within the meaning of the invention, to mean the entirety of the acoustically perceptible properties of the hearing device, from which at least some can be varied by way of settings to be carried out.

Prior to the decision as to whether or not a setting option of a parameter is also to be accessible to the hearing device wearer, the hearing device is firstly operated with a fixed reference value for this parameter in order to implement the inventive method, said reference value being selected according to an existing auditory situation in each instance such that an adjustment of this parameter objectively involves a high degree of effectiveness of this adjustment. In this setting, the hearing device wearer is enabled to perceive a sound example. The reference value of the parameter is then replaced by a deviating value of the parameter and the hearing device wearer has the task of relating the variable parameters back to the reference value by ear, by performing corresponding adjustments in the same auditory situation. The quality of this feedback is then evaluated.

To this end, after the hearing device wearer has terminated the adjustments, the amplification and transmission characteristics of the hearing device can be determined for instance and compared with those which the hearing device demonstrates, if it is operated with the fixedly predetermined reference value of the variable parameter. If the two amplification and transmission characteristics equate to or deviate only marginally from one another, and/or the deviations lie below a threshold value to be predetermined, which describes a tolerance range which is authoritative for the relevant decision on enablement, it can be derived therefrom that the efficiency of the tested adjustment option can be also perceived subjectively and evaluated quantitatively by the hearing device wearer and an adjustment option of this parameter can be enabled for the relevant hearing device wearer, since the risk of maladjustments in this case is minimal. If large differences remain between the two amplification and transmission characteristics after the hearing device wearer has performed the adjustments, it must be assumed that the efficiency of the tested adjustment options cannot be perceived subjectively by the hearing device wearer with sufficient clarity. The corresponding adjustment option on his/her hearing device is disabled, in order to prevent the risk of maladjustments.

As an alternative to comparing the hearing device characteristics, the reference settings can also be directly compared with the parameter settings performed by the hearing device wearer and likewise evaluated, which is particularly advantageous if adjustable parameters can be read out.

BRIEF DESCRIPTION OF THE DRAWINGS

The invention is described in more detail with reference to exemplary embodiments, in which.

DETAILED DESCRIPTION OF THE INVENTION

Figure 1:
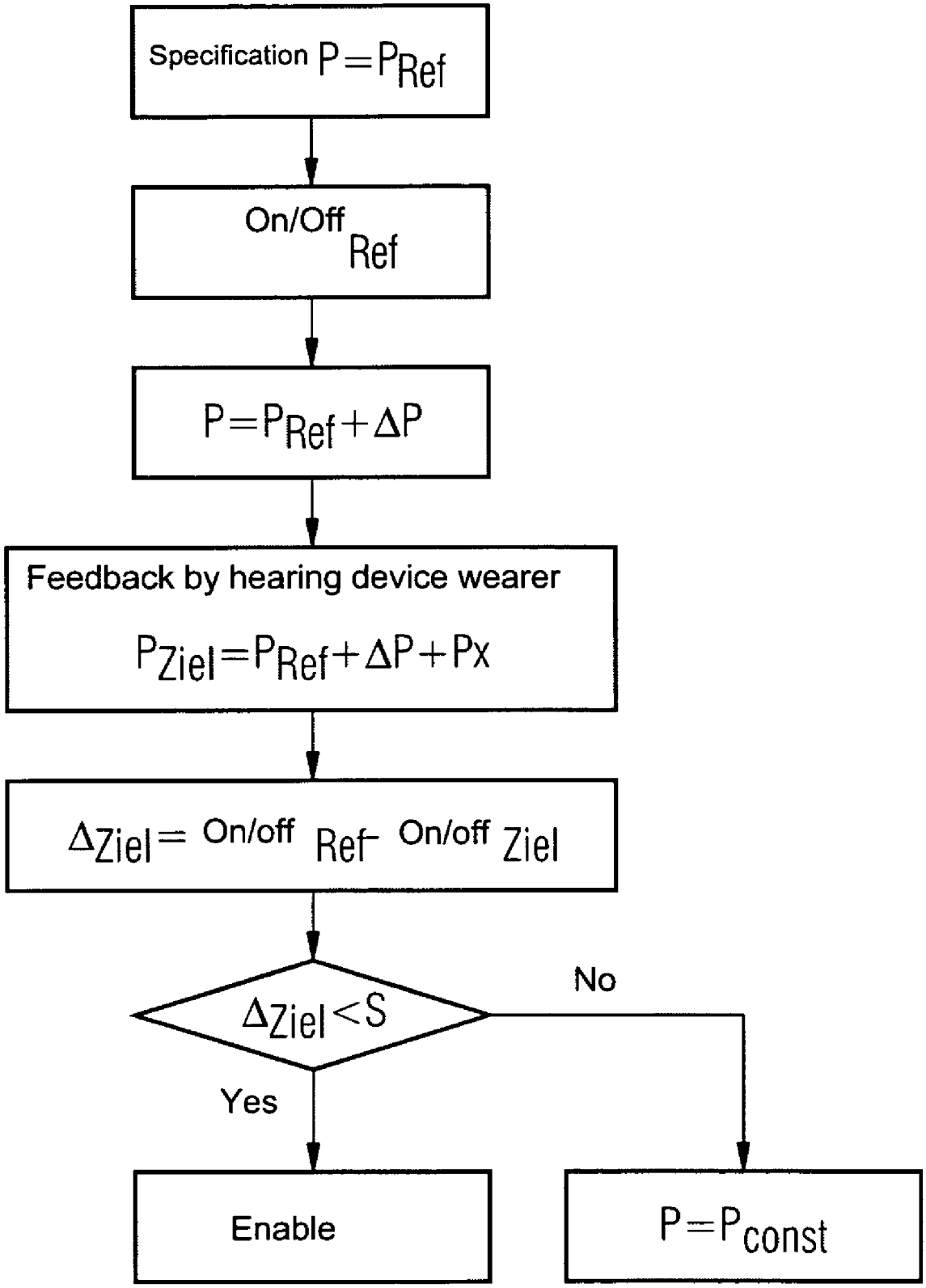
FIG. 1 shows a flow chart of the inventive method with an example of a variable parameter.

FIG. 1 shows a flow chart of the inventive method with an example of a variable parameter. A variable parameter is set to a fixed reference value $P_{Ref}$ in a first step. In a next step, a comparison of the incoming signal with the output signal of the hearing device is performed by means of a comparison operation and the result of this comparison is stored in the form of a quantitatively evaluatable value $on/off_{Ref}$. In a further step, the variable parameter P is set to a value which deviates from the reference value $P_{Ref}$ by an $\Delta P$. In a further step, the hearing device wearer is then given the option of varying the parameter P by performing corresponding adjustments, at the same time however he/she has the task of performing the variation of the parameter P by ear such that the hearing device has an amplification and transmission characteristic which equates as far as possible to that which it had when the parameter was set to the reference value $P_{Ref}$. The hearing device wearer will thus attempt to add a further element $P_X$ to the parameter value deviating from the reference value $P_{Ref}$ by $\Delta P$, and to achieve a target value $P_{Ziel}$, which lies as close as possible to the reference value $P_{Ref}$ originally set. In a further step, the remaining deviation between the reference value $P_{Ref}$ of the parameter and the target value $P_{Ziel}$ achieved by the hearing device wearer is then determined by quantitatively evaluatable values $on/off_{Ref}$ and $on/off_{Ziel}$ of both settings being extracted from one another in a comparison operation. The determined deviation $\Delta_{Ziel}$ allows the adjustments performed by the hearing device wearer to be evaluated. This then amounts in a further step in a distinction of cases as a function of a predetermined threshold value S. If the deviation $\Delta_{Ziel}$ is less than the predetermined threshold value, the adjustment option in respect of the tested parameter is then enabled. On the other hand, this adjustment option is disabled and the tested parameter is set to a constant value $P_{const}$. This may correspond to the reference value $P_{Ref}$, but may also assume changing values as a function of auditory situations identified in each instance and/or auditory programs available in the hearing device. During the described procedure, care is taken to ensure that the auditory situation does not change.

The inventive method can generally be implemented by using other quantitatively evaluatable variables, which can be assigned to the respective parameter settings. The adjusting states of actuators are included here, by way of whose actuation the parameter setting is realized and which can as a rule be easily read out or off. The illustrated variant using a comparison of the input and output signals in the case of different settings nevertheless simultaneously allows an assessment of the objective effect of the parameter variation and/or tested feature which is performed in accordance with the method. The term objective efficiency of the inventive method is understood to mean both technically provable influences on acoustic hearing device properties and also objective tests like for instance speech intelligibility tests. As a result, it is possible to ensure that during the implementation of the method, no auditory situation has arisen in which for objective reasons alone the hearing device wearer was unable to purposefully perform the required adjustments, since these would have shown no objective effect in the relevant auditory situation. It is then always advantageous if the method can be implemented not under laboratory conditions, in other words using optimized parameter specifications and sound examples, as is the case for instance with a spontaneous adjustment of a hearing device to a new and previously unclassified auditory situation. The inventive method always includes an interactive determination of a subjective efficiency of an examined parameter setting or adjustment. If this deviates significantly from the objective efficiency within the sense of a technically provable influence on the acoustic properties of the hearing device, this deviation can be made by way of enabling or disabling the possibility of adjusting the respective parameter, as a basis for the decision.

The inventive method thus provides the possibility of testing the efficiency of a parameter and/or the efficiency of its adjustment and making this test result the basis of an enabling decision. This occurs without data from a tone audiogram, or having to estimate and evaluate the age of the hearing device wearer and/or other soft factors.

This prevents the user of a hearing device without an individualized preselection from being provided with a feature and/or an adjustment option of a parameter, which would be useless to him and is associated with risk, such that the hearing device would be rejected on the grounds of unclear and/or poorly reproducible setting options.

Figure 2:
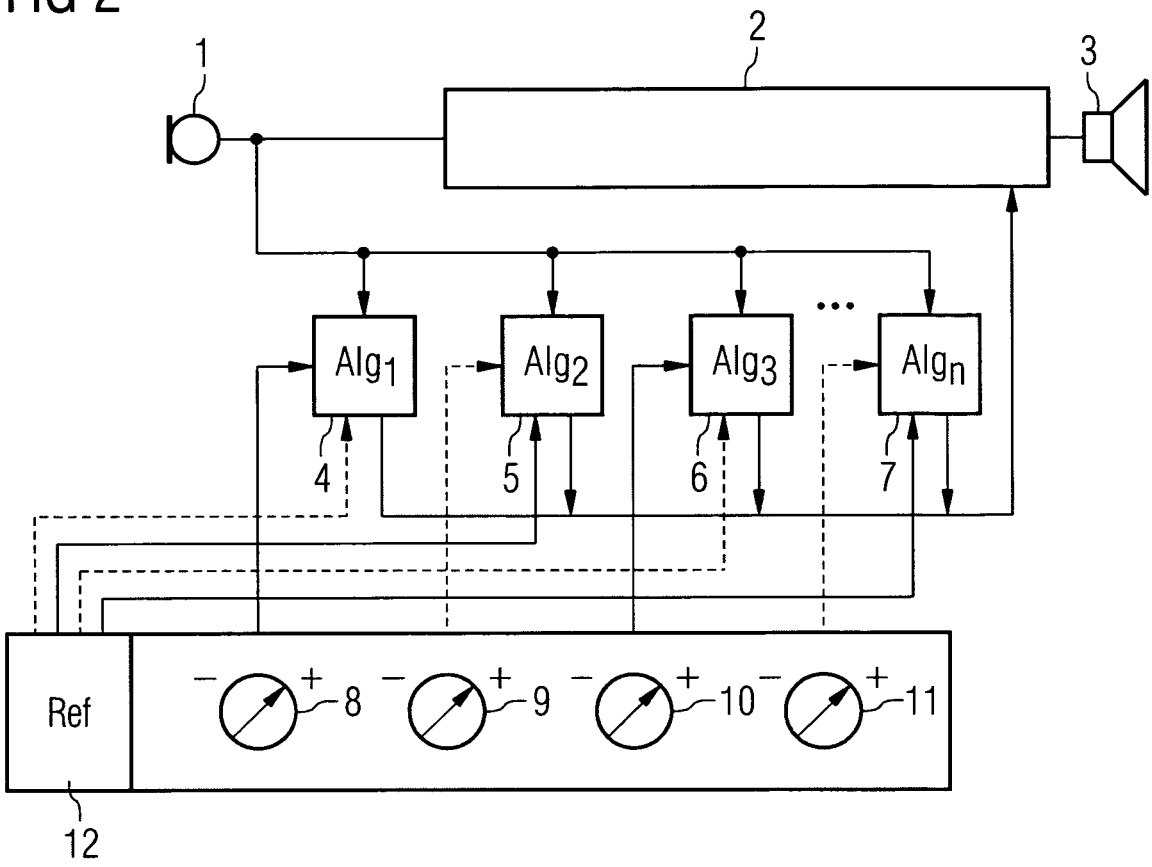
FIG. 2 shows a schematic representation of a hearing device, which is suited to implementing the inventive method.

FIG. 2 shows a schematic representation of a hearing device, which is suited to implementing the inventive method. This includes a signal transmission path, consisting of an input unit 1 in the form of a microphone, a signal processing and/or amplification unit 2 and an output unit 3 in the form of a loudspeaker. Signals incoming to the microphone can be routed to the output unit 3 in an amplified form. Furthermore, one or several signal processing units are included, in FIG. 1, e.g. four of such additional signal processing units 4, 5, 6, 7 are shown, in which incoming signals can be changed by a specific algorithm, before they are again fed to the signal processing and/or amplification unit 2 and into which a signal present at the output unit 3 flows. The further signal processing units 4, 5, 6, 7 can be configured here in a hardware-like fashion, separately or as an integral part of the signal processing and/or amplification unit 2 and/or consist solely in the provision of corresponding signal processing software. This is not taken into consideration for the functionality of the hearing device. The different algorithms in the signal processing units 4, 5, 6, 7 can include algorithms for different forms of interference noise suppression for instance but also relate to all other forms of signal processing desired in hearing devices. In order to influence the efficiency of the contained algorithms, one or several actuators are included, in FIG. 1, e.g. four of such additional actuators 8, 9, 10, 11 are shown, by way of which one or several parameters, upon which the efficiency of the respective algorithm depends, can be varied. The actuators 8, 9, 10, 11 can be individually enabled or disabled, which amounts to an enabling or disabling of the influence on the parameters to be adjusted in each instance. A reference sensor 12 is also included, which, instead of the parameters which can be adjusted by way of the actuators 8, 9, 10, 11 in each instance, can generate a reference value $_{Ref}$ and/or different constant values $P_{const}$ and apply it to the corresponding signal processing units 4, 5, 6, 7.

In the example shown, the method according to the invention was implemented for the individual algorithms $Alg_1$ to $Alg_n$, with a disabling of the corresponding adjustment option having been determined for the algorithms $Alg_1$ and $Alg_3$, while an enabling of this type was refused for the remaining algorithms (connection of the actuators 9, 11 shown with a dashed line). Prior to said enabling, the hearing device wearer was not able to use the adjustment options which can be implemented with the actuators 9, 11 such that according to the inventive method, it was possible to achieve a purposeful feedback of the adjusted parameters to the required reference value $P_{Ref}$. The actuators 8 and 10 allow this feedback to be implemented successfully.

Instead of the variable parameter on the signal processing units 5, 7, constant parameter values are applied, which, as output values of the reference sensor 12, can correspond to the reference values $P_{Ref}$ needed to implement the method, but can also assume alternating constant values $P_{const}$ as a function of identified auditory situations and/or auditory programs available in the hearing device in each instance. In this way, only two variable parameters remain in each case for an adjustment of the hearing device after the method according to the invention has been implemented, which significantly reduces the risk of maladjustments compared with an enabling of all adjustment options, and considerably simplifies the setting procedure for the hearing device wearer.

The represented procedure can be included in the configuration of a hearing device in a different fashion. Different configurations can be linked to different auditory situations and/or auditory programs. An inventive enabling or disabling of adjustment options of a hearing device just prior to being issued to the hearing device wearer basically takes place in one session with the hearing device acoustician. Auditory situations and sound examples can be simulated and generated respectively under lab conditions there and are optimally attuned to the evaluation of the abilities of the hearing device wearer in order to use certain features and adjustment options. Corresponding test algorithms can in this case be included in a programming device of the hearing device acoustician.

In a further advantageous embodiment of the method according to the invention, a new configuration takes place under real operating conditions after identifying an auditory situation in which no configuration of the adjustment options of the hearing device were previously performed, before adjustment options selected in this auditory situation are available to the hearing device wearer. To identify an auditory situation which requires a new configuration, classification systems can be used in a manner known per se, which are frequently available for the automatic selection of different auditory programs.

The method according to the invention is to be used particularly advantageously in conjunction with learning algorithms, for instance in connection with so-called trainable hearing aids, since in systems of this type, the performance of faulty settings potentially results in a long-lasting unsatisfactory adjustments of the hearing device to changing auditory situations and/or impedes learning processes. Particularly prior to the use of adjustment options, which influence parameters as input variables of learning algorithms, the user is already tested as to whether he/she is able to use the system in a meaningful and purposeful manner.

In addition to auditory programs which are, if necessary, stored in his/her hearing device for automatic adjustment to different auditory situations, the user is advantageously offered two further programs, which are used for the inventive configuration of the adjustment options of the hearing device. A reference setting of at least one parameter is stored in a program, the adjustment option of which is to be enabled or disabled. In a second program, this reference setting is adjusted such that this can be put into the reference adjustment with the aid of the adjustment option to be tested. The hearing device wearer may in this case have the task to be achieved by ear, the solution of which consists in finding a setting of the parameter to be tested, in which the hearing device in both programs sounds the same as or is at least similar to the user, in other words provides an identical speech intelligibility for instance. The inventive configuration of the setting options of the hearing device can be realized in this way without any great effort. The inventive method can be implemented in one stage or in multiple stages and with different degrees of difficulty. In the case of a multistage embodiment, the next stage can be introduced in each instance as a function of the successful completion of a preceding stage, in order to avoid the unnecessary effort involved in too many test steps.

To this end, it could be that the procedure is implemented in several steps, with, in a first step, only adjustment options which are simple to evaluate, in the case of a trainable hearing aid, the loudspeaker controller for instance, having to be used in order to complete the object to be achieved by ear. In further steps, more complex settings must then be performed, which at least require the abilities which were already tested in the first step. With a trainable hearing aid, this could be the setting of the tone control for instance. To this end, the complexity of the object could also be increased by varying the signals and/or sound examples shown, in order thus to be able to assess whether the respective hearing device wearer is suited to an independent execution of the tested adjustment options.

The method according to the invention is described again with reference to exemplary embodiments relating to two concrete setting options of a hearing device. The first example relates to a hearing device with an activatable directional microphone. The hearing device with several auditory programs has inter alia a microphone system, which can be manually switched between omnidirectional directional characteristics and unidirectional directional characteristics and adjusted. This feature allows speech in a noisy environment to be better understood from a certain direction if the hearing device is operated with a directionally active microphone system. It must naturally be ensured that settings are performed in respect hereof in order to vary the directional characteristics are performed such that the adjustment of the directional characteristics to a certain auditory situation does not deteriorate after an adjustment has been performed, but is instead improved as far as possible.

According to the inventive method, the following procedure is adopted for this purpose:

A reference setting is firstly stored in a first auditory program of the hearing device, in which the microphone system is operated in a reference mode with a defined directional characteristic. A hearing device setting is stored in a second auditory program, in which the microphone setting is changed in respect of the directional characteristic in comparison with the reference mode, but can however be changed by the hearing device wearer. A test signal, for instance a speech signal from 0° and an interference noise from 180° is played to the hearing device wearer and the hearing device wearer has the task of setting the microphone system in the second program such that he is given the impression that the speech can be understood equally as well with both programs and the subjective understanding of speech is thus the same.

The remaining deviation of the final setting from the reference adjustment which is performed by the hearing device wearer, is recorded directly or indirectly.

A check is then carried out to determine whether the recorded deviation still lies within a tolerance range, which is defined according to physiological and/or technical edge conditions. If the deviation lies within the tolerance range, the hearing device wearer is suited to interactively setting the microphone system of the hearing device in respect of his/her directional characteristic. The corresponding adjustment option is enabled. If the deviation lies outside the tolerance range however, the hearing device wearer is not suited to performing this setting him/herself in order to adjust his/her hearing device to different auditory situations. In this case, the hearing device must thus be adjusted in a different manner to the individual requirements of the hearing device wearer, for instance by specifying directional characteristics, which automatically adjust to the classified auditory situations and cannot be changed.

The second example relates to a hearing device with a separate amplification in a high tone and a low tone channel. A hearing device with several auditory programs has amplifications which can be set independently of one another in a high tone ($GAIN_{HB}$) and low tone channel ($GAIN_{LB}$). This arrangement allows the amplification to be changed in a broad band fashion, by $GAIN_{HB}$ and $GAIN_{LB}$ being changed at the same time, which corresponds to an adjustment of the volume. Both amplifications can however also be changed separately from one another so that the frequency response is shaped.

To monitor possible adjustment options to be enabled in respect of the amplification, the following procedure is adopted:

A reference setting with a predetermined amplification is firstly stored in a first auditory program of the hearing device. A hearing device setting is stored in a second auditory program, with which the amplification is set in a broadband fashion deviating from the reference setting, but can however be changed by the hearing device wearer. A test signal, for instance a speech signal in a quiet environment, is then played to the hearing device wearer and the hearing device wearer has the task of changing the amplification by using the adjustment options according to a second program such that the test signal is perceived with the same loudness in both programs.

The remaining deviation of the final setting performed by the hearing device wearer from the reference setting is recorded directly or indirectly.

A test is then carried out to determine whether the detected deviation still lies within a tolerance range, which is determined according to the initial physiological and/or technical conditions. If this is the case, the amplification in the second auditory program is then separately changed in comparison with the reference setting in the first auditory program in both channels so that a frequency-dependent component is also effective for overall amplification. The hearing device wearer again has the task, when presented with a test signal, to change the amplification by using the adjustment options of the second auditory program such that the test signal is perceived with the same loudness and in the same way in both programs. The remaining deviation of the final setting performed by the hearing device wearer from the reference setting is detected again directly or indirectly.

A check is then carried out again to detect whether the detected deviation still lies within a tolerance range, which is defined according to initial physiological and/or technical conditions.

If the deviations lie within the tolerance ranges, the hearing device wearer is suited to interactively setting the amplification of the hearing device both in a broadband fashion as well as in a frequency-selective fashion. The corresponding adjustment options are enabled. If, however, the deviations lie outside the tolerance ranges, the hearing device wearer is not suited to performing these settings in order to adjust his/her hearing device to different auditory situations. In this case, the hearing device must be adjusted in a different way to the individual requirements of the hearing device wearer, for instance by specifying amplification characteristics which automatically adjust in classified auditory situations and cannot be changed.

In the last exemplary embodiment, a two stage examination takes place prior to the adjustment options being enabled in each instance. This multistage arrangement allows premature interruption in the method according to the invention in order to save on subsequent examinations.

If the first setting object has been achieved in the present example by the hearing device wearer, but the second fails, a broadband adjustment of the amplification only is enabled for him/her with the aim of effecting volume control. If the first setting object fails however, this enabling is also omitted and the following step of testing the ability of purposefully performing frequency-selective settings can be completely omitted.

To implement the method according to the invention, apparatuses for configuring at least one adjustment option to a hearing device are suited, which have means for specifying at least one reference setting of at least one parameter, means for adjusting this parameter and means for enabling or disabling the adjustment of this parameter, with the means for enabling or disabling the adjustment of this parameter being designed such that they effect an enabling of the adjustment once the hearing device wearer has performed an adjustment of the parameter by intentionally specifying the reference setting in accordance with the hearing, so that the hearing device has a characteristic which equates to the characteristic of the hearing device in the reference setting or has deviations herefrom which lie within a predetermined tolerance range. Provision can be advantageously made for an automation of the method if the means for specifying at least one reference setting of at least one parameter, the means for adjusting this parameter and the means for enabling or disabling the adjustment of this parameter are fixedly connected to the hearing device.

Means are also advantageously included which set at least one parameter, which can be varied in the case of an enabling adjustment option, to a constant value $P_{const}$ in the case of the adjustment option which is disabled.

The means for adjusting the at least one parameter advantageously include means for adjusting at least one parameter, which can be adjusted to different auditory situations during the training of a hearing device for adjustment purposes, at least one parameter which relates to the efficiency level of algorithm for interference noise suppression, at least one parameter which relates to the setting of the frequency dependency of the transmission and amplification characteristics and/or at least one parameter which relates to the adjustment of the directional characteristics of the hearing device.

The invention claimed is:

1. A method for a configuration of an adjustment option of a parameter for a hearing device, the hearing device having a user operable input device for adjusting said parameter, the method comprising:

setting the parameter to a reference value and generating a reference output signal corresponding to the reference value of the parameter;

setting the parameter to a test value deviating from the reference value by a predetermined value;

generating an output signal corresponding to the test value of the parameter;

adjusting the output signal to the reference output signal by varying the parameter by operating the user operable input device;

determining the deviation between the reference value and the parameter after adjustment; and enabling the adjustment option of the parameter via the user operable input device if a criteria that the deviation is below a predetermined threshold value is satisfied, and disabling the adjustment option of the parameter via the user operable input device if the criteria is not satisfied.

2. The method as claimed in claim 1, wherein the parameter is set to a constant value in the adjustment option which is disabled.

3. The method as claimed in claim 2, wherein the constant value is set corresponding to the reference value which is used to test a subjective efficiency of the adjustment option.

4. The method as claimed in claim 2, wherein the constant value is stored in an auditory program by the user or is automatically stored after a classification of an auditory situation.

5. The method as claimed in claim 1, wherein the adjustment option comprises to adjust the parameter to different auditory situations during a training of the hearing device.

6. The method as claimed in claim 1, wherein the adjustment option comprises to adjust the parameter relating to an efficiency level of an algorithm.

7. The method as claimed in claim 1, wherein the adjustment option comprises to adjust the parameter for setting a frequency dependency of a transmission and amplification characteristic.

8. The method as claimed in claim 1, wherein the adjustment option comprises to adjust the parameter for setting a directional characteristic of the hearing device.

9. The method as claimed in claim 1, wherein the enabling of the adjustment option is automatically monitored if a non-classified or initially classified auditory situation arises.

10. The method as claimed in claim 1, wherein a first parameter and a second parameter are set in the adjustment option and a two-stage test takes place prior to the enabling of the adjustment option.

11. The method as claimed in claim 10, wherein a broadband adjustment of an amplification is released if the first parameter is enabled and the second parameter is disabled.

12. The method as claimed in claim 11, wherein the enabling of the adjustment option is dispensed for the broadband adjustment of the amplification if the first parameter is disabled.

13. A hearing device, comprising:

a reference sensor that sets a parameter of the hearing device to a reference value and subsequently sets the parameter to a test value, wherein the test value deviates from the reference value by a predetermined value;

an output signal unit that generates a reference output signal corresponding to the reference value of the parameter and further generates a test output signal corresponding to the test value of the parameter; and an actuator operable by a user for varying the parameter so as to adjust the test output signal to the reference output signal, wherein the reference sensor determines a deviation between the reference value and the parameter after adjustment, and wherein an adjustment option of the parameter is enabled if a criteria that the deviation is below a predetermined threshold value is satisfied, and wherein the adjustment option of the parameter is disabled if the criteria is not satisfied.

14. The hearing device as claimed in claim 13, wherein the reference sensor sets the parameter to a constant value in the adjustment option which is disabled.

15. The hearing device as claimed in claim 13, wherein the actuator adjusts the parameter to different auditory situations during a training of the hearing device.

16. The hearing device as claimed in claim 13, wherein the actuator adjusts the parameter relating to an efficiency level of an algorithm.

17. The hearing device as claimed in claim 13, wherein the actuator adjusts the parameter for setting a frequency dependency of a transmission and amplification characteristic.

18. The hearing device as claimed in claim 13, wherein the actuator adjusts the parameter for setting a directional characteristic of the hearing device.

19. The hearing device as claimed in claim 18, wherein the hearing device is switched between an omnidirectional directional characteristic and a unidirectional directional characteristic.

* * * * *